US012128521B2

(12) United States Patent
Hwang et al.

(10) Patent No.: US 12,128,521 B2
(45) Date of Patent: Oct. 29, 2024

(54) APPARATUS FOR FORMING A HAIRLINE FINISH

(71) Applicant: Jae Sang Hwang, Seoul (KR)

(72) Inventors: Jae Sang Hwang, Seoul (KR); Wan Seob Song, Seoul (KR)

(73) Assignee: Jae Sang Hwang, Seoul (KR)

( * ) Notice: Subject to any disclaimer, the term of this patent is extended or adjusted under 35 U.S.C. 154(b) by 474 days.

(21) Appl. No.: 17/006,696

(22) Filed: Aug. 28, 2020

(65) Prior Publication Data

US 2021/0146496 A1 May 20, 2021

(30) Foreign Application Priority Data

Jul. 1, 2019 (KR) ..... 10-2019-0078943

(51) Int. Cl.
*B24B 23/00* (2006.01)
*B24B 23/02* (2006.01)

(52) U.S. Cl.
CPC ..... *B24B 23/005* (2013.01); *B24B 23/022* (2013.01)

(58) Field of Classification Search
CPC ..... B24B 23/005; B24B 23/02; B24B 23/022; B24B 45/006
USPC ..... 451/241, 282
See application file for complete search history.

(56) References Cited

U.S. PATENT DOCUMENTS 2,625,860 A * 1/1953 Plester ..... B23Q 35/105 409/181
3,212,541 A * 10/1965 Burrows ..... B23C 3/126 144/134.1
3,893,372 A * 7/1975 Strakeljahn ..... B24B 23/08 144/136.95
4,590,713 A * 5/1986 Yasui ..... B24B 23/005 451/442
4,820,090 A * 4/1989 Chen ..... B25F 5/027 81/177.4
6,449,852 B1 * 9/2002 Simantel ..... B27B 5/30 30/373
6,702,656 B1 * 3/2004 Hibbert ..... A63C 11/06 451/344
7,310,879 B1 * 12/2007 Clarke ..... B27B 5/08 451/451
7,677,281 B2 * 3/2010 Baker ..... B27G 23/00 409/206
8,845,397 B1 * 9/2014 LeFever ..... B24B 41/06 451/342
9,149,923 B2 * 10/2015 Campbell ..... B25F 5/003
9,908,211 B2 * 3/2018 Olberg ..... B24B 23/005
(Continued)

FOREIGN PATENT DOCUMENTS

JP H06-024855 U 4/1994
JP 2016187840 A 11/2016
(Continued)

*Primary Examiner* — Joel D Crandall
*Assistant Examiner* — Marcel T Dion
(74) *Attorney, Agent, or Firm* — Heidi Eisenhut; LOZA & LOZA, LLP

(57) ABSTRACT

An apparatus for forming the hairline on a target material according to the embodiment includes a body including a rotation shaft, an abrasive member, a first bracket for fixing the abrasive member to the rotation shaft, and a guide unit disposed between the body and the rotation shaft along a longitudinal direction of the rotation shaft.

12 Claims, 12 Drawing Sheets

(56) References Cited

U.S. PATENT DOCUMENTS

| | | | | |
|---|---|---|---|---|
| 2002/0132570 | A1* | 9/2002 | Berg | B24B 23/005 451/344 |
| 2003/0002946 | A1* | 1/2003 | Hsieh | B24B 23/02 409/218 |
| 2003/0075028 | A1* | 4/2003 | Hofmann | B24B 23/02 83/564 |
| 2008/0264225 | A1* | 10/2008 | Crain | B23D 59/006 83/478 |
| 2011/0072946 | A1* | 3/2011 | Bernardi | B26B 29/06 83/522.11 |
| 2012/0031636 | A1* | 2/2012 | King | B25B 23/08 173/20 |

FOREIGN PATENT DOCUMENTS

| | | | |
|---|---|---|---|
| KR | 200315610 | Y1 | 6/2003 |
| KR | 1020100090176 | A | 8/2010 |

* cited by examiner

APPARATUS FOR FORMING A HAIRLINE FINISH

CROSS-REFERENCE TO RELATED APPLICATION

This application claims under 35 U.S.C. § 119 to Korean Patent Application No. 10-2019-0078943 filed Jul. 1, 2019, which is hereby incorporated by reference in its entirety

TECHNICAL FIELD

The embodiment relates to an apparatus for forming a hairline finish on a target material.

BACKGROUND ART

A vacuum chamber has a door area, and the door area has an open area and a circumferential area.

Various components are assembled on the circumferential area of the door area and strong sealing is required for the assembly surface wherein various components are assembled on the circumferential area of the door area of the vacuum chamber.

According to the internal technology, a sealing surface, which is the surface of the sealing part, is located around the open area of the target material, and the sealing surface needs to be formed with a hairline for stronger sealing.

In this application, "hairline" may mean forming accurate scratches such as a hairline in beauty on the sealing surface, but is not limited thereto.

In the related art, a worker used a polishing member such as sandpaper to directly rub the sealing surface of the door area of the target material to form a hairline. Accordingly, in the related art, there is a technical problem in that a hairline is formed in a region other than the sealing surface where the sealing component contacts.

In addition, there is a technical problem that it is difficult to secure uniform roughness since a hairline is formed by rubbing with a worker's hand using an abrasive member such as sandpaper.

In addition, it takes a considerable amount of time to form a hairline having a certain level of roughness by an abrasive member such as sandpaper, and thus there is a problem that the processing time is increased.

DISCLOSURE

Technical Problem

One of the technical problems to be solved of the embodiment is to provide an apparatus for forming a hairline of a target material capable of accurately forming a hairline on a sealing surface.

In addition, one of the technical problems to be solved of the embodiment is to provide an apparatus for forming a hairline of a target material that can secure a uniform roughness.

In addition, one of the technical problems to be solved of the embodiment is to the embodiment is one of the technical problems to provide an apparatus for forming a hairline of a target material that can quickly and accurately secure a hairline of uniform roughness.

The technical problem of the embodiment is not limited to this item and includes what can be recognized through the specification.

Technical Solution

An apparatus for forming a hairline of a target material according to an embodiment includes: a body including a rotation shaft; an abrasive member; a first bracket for fixing the abrasive member to the rotating shaft; and a guide unit disposed between the body and the rotation shaft along a longitudinal direction of the rotation shaft.

According to another aspect of the embodiment, an apparatus for forming a hairline of a target material includes: a body including a first rotation shaft; a second rotation shaft fastened to the first rotation shaft; an abrasive member; a guide unit disposed between the second rotation shaft and the abrasive member; and a fastening part for fixing the abrasive member and the guide unit to the second rotation shaft. The guide unit and the abrasive member may be in surface contact.

Advantageous Effects

According to the apparatus for forming the hairline of the target material according to an embodiment, there is a technical effect of accurately forming a hairline on a sealing surface.

In addition, according to the embodiment, there is a technical effect of securing a uniform roughness.

Further, according to the embodiment, there is a technical effect of securing a hairline of uniform roughness quickly and accurately.

For example, according to at least one of the embodiments, polishing is performed by accurately positioning the abrasive member on the sealing surface of the target material using a guide unit located near the abrasive member, thereby accurately forming a hairline on the sealing surface of the target material. have. Accordingly, not only the process time for forming the hairline can be drastically shortened, but also the easy and accurate hairline can be formed, thereby remarkably improving the sealing quality of the target material.

Further scope of applicability of the embodiments will become apparent from the detailed description below. However, various changes and modifications within the spirit and scope of the embodiments may be clearly understood by those skilled in the art, and thus specific embodiments such as detailed description and preferred embodiments should be understood as being given by way of example only.

DETAILED DESCRIPTION OF THE EMBODIMENTS

Hereinafter, embodiments of the present invention will be described in detail with reference to the accompanying drawings. However, the technical idea of the present invention is not limited to the embodiments to be described, but may be implemented in various different forms, and it can be combined with and substituted for use within the scope of the technical idea of the present invention, one or more of the constituent elements may be selectively selected between the embodiments.

In addition, terms (including technical and scientific terms) used in the embodiments of the present invention are generally understood by those of ordinary skill in the art, unless explicitly defined and described. It can be interpreted as a meaning, and terms generally used, such as terms defined in a dictionary, may be interpreted in consideration of the meaning in the context of the related technology.

In addition, terms used in the embodiments of the present invention are for describing the embodiments and are not intended to limit the present invention. In the present specification, the singular form may also include the plural form unless specifically stated in the phrase, and when described as "at least one (or more than one) of A, B and C", it may be combined into A, B, and C and one or more of all combinations may be included.

In addition, terms such as first, second, A, B, (a), and (b) may be used in describing the constituent elements of the embodiment of the present invention. These terms are only for distinguishing the component from other components, and are not limited to the nature, order, or order of the component by the term. And when a component is described as being 'connected', 'coupled' to another component, the component is not only directly connected or coupled to the other component, but also the component and the case of being 'connected' or 'coupled' by another element between the other elements may also be included.

In addition, when it is described as being formed or disposed in the "top or bottom" of each component, the top or bottom is one as well as when the two components are in direct contact with each other. It also includes a case in which the above other component is formed or disposed between the two components. In addition, when expressed as "upper or lower", the meaning of not only an upward direction but also a downward direction based on one component may be included.

Figure 1:
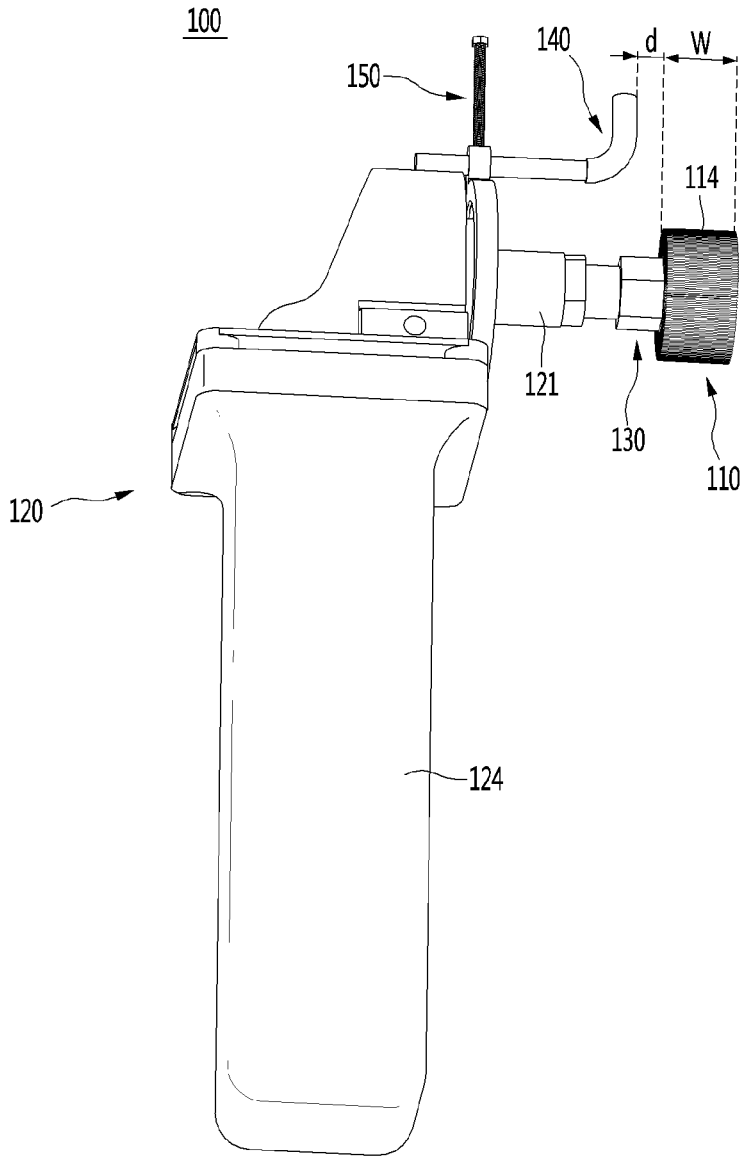
FIG. 1 shows an apparatus for forming a hairline according to a first embodiment.
Figure 2:
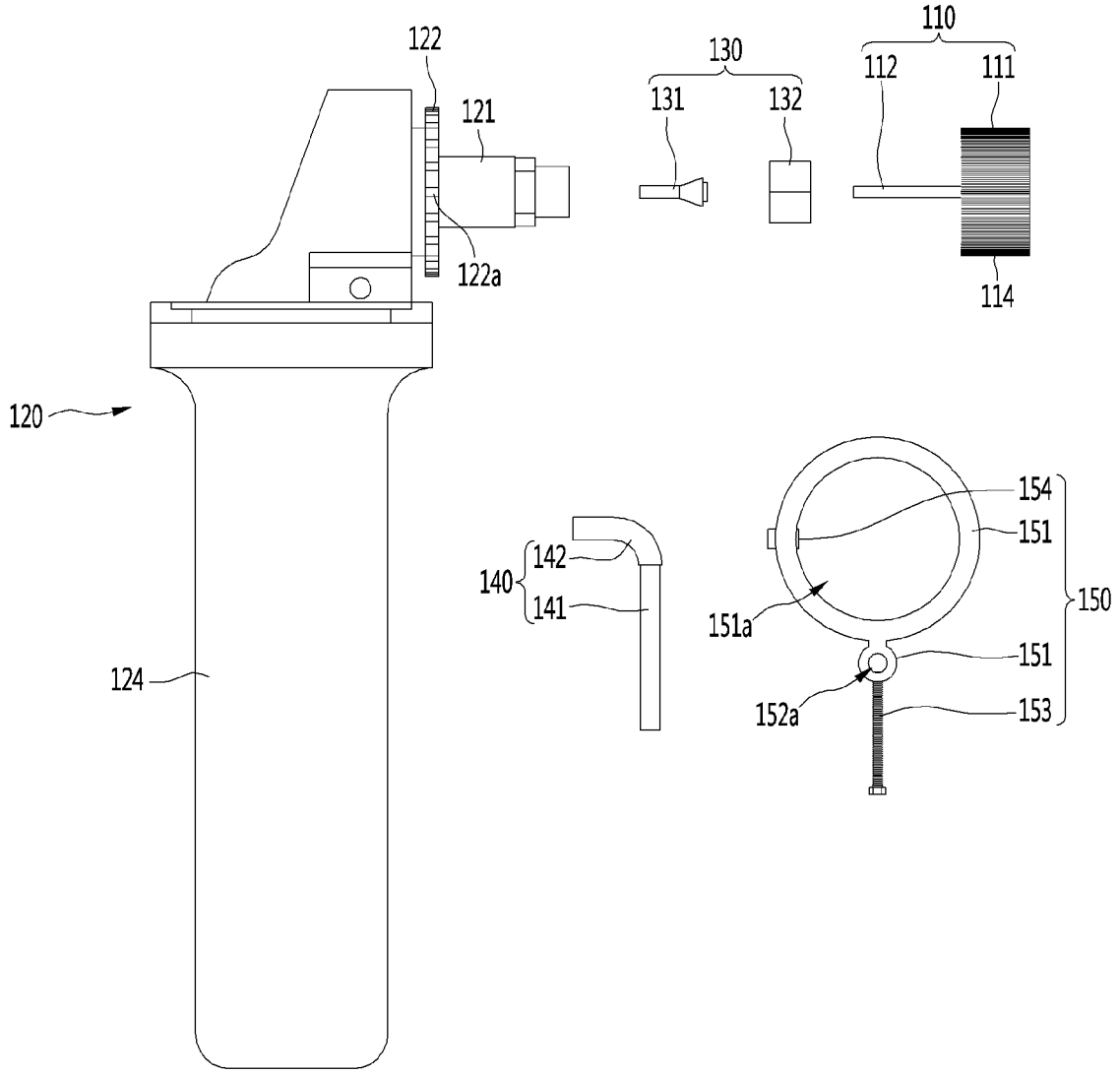
FIG. 2 is an exploded view of the apparatus for forming the hairline according to the first embodiment.

FIG. 1 shows an apparatus for forming a hairline according to a first embodiment, and FIG. 2 is an exploded view of an apparatus for forming a hairline according to the first embodiment.

Referring to FIGS. 1 and 2, the apparatus for forming the hairline according to the first embodiment may include a body 120, an abrasive member 110, a first bracket 130, and a guide unit 140.

The apparatus for forming the hairline 100 according to the first embodiment may rotate the abrasive member 110 by driving by a power source. The power source may be supplied from a battery or may be supplied from an external power supply.

The body 120 may support the abrasive member 110, the first bracket 130 and the guide unit 140. Referring to FIG. 2, the body 120 may include a mounting portion 122 provided at the front end and a handle 124 provided at the rear end. The operator may perform the polishing operation by holding the handle 124 of the body 120. The second bracket 150 may be mounted on the mounting portion 122, which will be described in detail later. A drive unit (not shown) capable of rotating the rotation shaft 121 may be mounted in the body 120.

Figure 4:
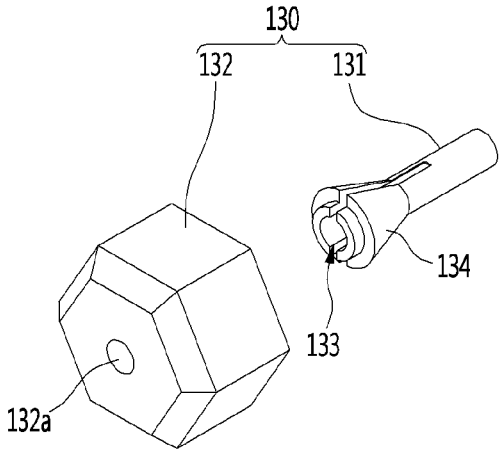
FIGS. 4 to 8 show a process of assembling the apparatus for forming a hairline according to the first embodiment.

Referring to FIG. 4, the first bracket 130 may fix the abrasive member 110 to the rotation shaft 121 of the body 120. The first bracket 130 may include a pressing member 132 that presses the rotation shaft 131 and the rotation shaft 131. An insertion groove 133 may be formed at one side of the rotation shaft 131.

One side of the rotation shaft 131 may include at least one separation region 134 separated and spaced apart along the rotation radius. When the rotation shaft 131 is inserted into the pressing member 132, each separation region 134 is pressed, so that a space between the separation regions 134 may be reduced. Accordingly, the diameter of the insertion groove 133 of the rotation shaft 131 may be reduced by the pressing of the pressing member 132. For example, after the rotation shaft 131 of the abrasive member 110 is inserted into the insertion groove 133 of the rotation shaft 131 through the hole 132*a* of the pressing member 132 of the first bracket 130, the pressing member 132 pressed by each separation region 134 of the rotation shaft 131 is also pressed so that the rotation shaft 131 of the abrasive member 110 may be firmly fixed by each separation region 134.

Figure 3:
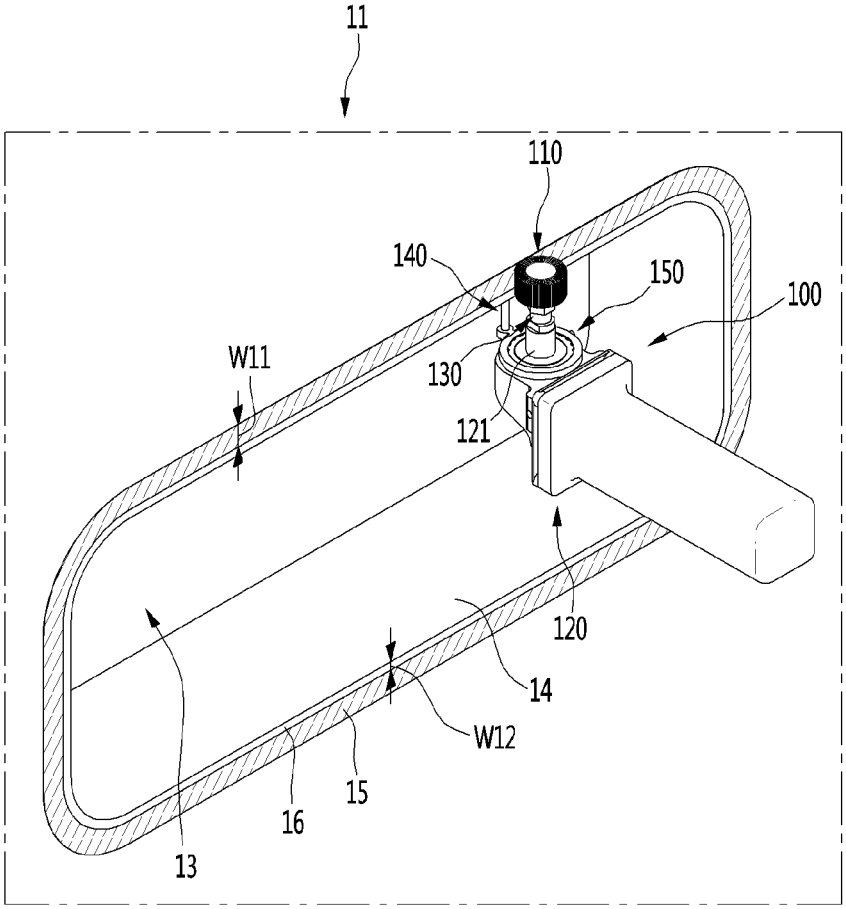
FIG. 3 shows a state of polishing a molding surface of an object by using the apparatus for forming a hairline according to the first embodiment.

Referring to FIG. 3, the abrasive member 110 may polish a specific area of the target material 11. The specific area may be the sealing surface 15 on which the hairline is to be formed.

The target material 11 may be a chamber for a semiconductor manufacturing process or a display manufacturing process. In addition, the target material 11 may be an industrial tank or industrial piping. In addition, all members used in various fields and requiring a polishing may be included in the technical idea of the present invention.

The target material 11 may include a plurality of open areas 13. The open area 13 can be sealed by a sealing element. The sealing component is, for example, a window made of a transparent material, and the internal state of the target material 11 can be checked during the process. The sealing component is, for example, a detection device, and may measure or detect a temperature, a vacuum, or a process state inside the target material 11 during processing. In addition to this, various sealing components may be installed in the open area 13.

The sealing surface 15 may be positioned around the open area 13 of the target material 11. In addition, the non-sealing surface 16 may be positioned between the open area 13 and the sealing surface 15 of the target material 11. That is, the non-sealing surface 16 may be in contact with the open area 13 and the sealing surface 15 may be positioned along the circumference of the non-sealing surface 16. The sealing surface 15 is a region where the sealing component is in contact, and the non-sealing surface 16 may be a region where the sealing component is not in contact. The non-sealing surface 16 may not be present depending on the target material 11. In this case, the sealing surface 15 may directly contact the open area 13.

Due to the hairline formed by the abrasive member 110, the sealing surface 15 is strongly sealed by the sealing component, so that the sealing force can be strengthened. The abrasive member 110 may be rotated in one direction, for example, in a clockwise direction with respect to the rotation shaft 121.

Referring to FIG. 2, the outer surface of the abrasive member 110 may have a polishing surface 114. Accordingly, the polishing surface 114 of the abrasive member 110 may be in surface contact with the sealing surface 15 of the target material 11. The abrasive member 110 may have a circular shape, but is not limited thereto.

The abrasive member 110 may include a grinding paper 111 having a polishing surface 114 formed along the outer periphery and a rotation shaft 112 extending in one direction from the grinding paper 111. The rotation shaft 112 of the abrasive member 110 may be inserted and fixed to the rotation shaft 131 of the first bracket. A polishing surface 114 may be formed along the outer periphery of the grinding paper 111. The grinding paper 111 and the rotating shaft may be collectively referred to as polishing paper.

On the other hand, when the non-sealing surface 16 of the target material 11 is positioned between the open area 13 and the sealing surface 15, it is difficult in the prior art to form a hairline accurately only on the sealing surface 15 of the target material 11.

In the first embodiment, by using the guide unit 140 positioned near the abrasive member 110 to accurately position the abrasive member 110 on the sealing surface 15 of the target material 11 and polishing is performed, it is possible to accurately form a hairline on the sealing surface 15 of the target material 11.

Accordingly, according to the embodiment, not only the process time for forming the hairline can be drastically shortened, but also it is possible to easily and accurately form the hairline, thereby minimizing the sealing defect of the target material 11.

Referring to FIG. 2, the guide unit 140 may guide the abrasive member 110 to be accurately positioned on the sealing surface 15 of the target material 11. The guide unit 140 may be disposed between the body 120 and the abrasive member 110. For example, the guide unit 140 may be disposed between the mounting part 122 of the body 120 and the abrasive member 110. The guide unit 140 may be disposed along a length direction of the rotation shaft 121. The guide unit 140 may be disposed parallel to the rotation shaft 121, but is not limited thereto.

The guide unit 140 may be inserted into the insertion part 152 and may include a guide bar 141 extending in one direction. The guide unit 140 may include a bent part 142 that is bent at one side of the guide bar 141. The guide bar 141 and the bent portion 142 may be integrally formed, but are not limited thereto. The guide bar 141 may be disposed between the body 120 and the abrasive member 110. For example, the guide bar 141 may be disposed between the mounting portion 122 of the body 120 and the abrasive member 110.

The guide bar 141 may be disposed along a length direction of the rotation shaft 121. The guide bar 141 may be disposed parallel to the rotation shaft 121, but is not limited thereto. The length of the bent portion 142 may be equal to or smaller than the length of the guide bar 141. One side of the guide bar 141 may be fixed to the body 120 through the second bracket 150, and the other side of the guide bar 141 may be located near the abrasive member 110.

The bent part 142 may be bent from the other side of the guide bar 141. For example, the bent part 142 may be bent vertically from the other side of the guide bar 141. For example, the bent portion 142 may be bent from the other side of the guide bar 141 to be disposed parallel to the inner surface 14 of the open area 13 of the target material 11.

For example, the other side of the guide bar 141 may be spaced apart from the abrasive member 110. The separation distance d between the other side of the guide bar 141 and the abrasive member 110 may be greater than zero. For example, when the target material 11 does not have the non-sealing surface 16, that is, when the sealing area contacts the open area 13 of the target material 11, the separation distance d between the other side of the guide bar 141 and the abrasive member may be 0. That is, the other side of the guide bar 141 may be located on the same line as the abrasive member 110. The same line may be a line in a direction perpendicular to the rotation axis 121.

Referring to FIG. 3, for example, the distance d between the other side of the guide bar 141 and the abrasive member 110 may be the same as the width W12 of the non-sealing surface 16 of the target material 11. The width W of the abrasive member 110 may be the same as the width W11 of the sealing surface 15 of the target material 11.

For example, the bent portion 142 may be spaced apart from the abrasive member 110. A separation distance d between the bent portion 142 and the abrasive member 110 may be greater than zero. For example, when the target material 11 does not have the non-sealing surface 16, that is, when the sealing area contacts the open area 13 of the target material 11, the separation distance d between the bent portion 142 and the abrasive member 110 may be 0. That is, the bent portion 142 may be positioned on the same line as the abrasive member 110. For example, the distance d between the bent portion 142 and the abrasive member 110 may be the same as the width W12 of the non-sealing surface 16 of the target material 11.

For example, the bent portion 142 may be disposed on the same line as the abrasive member 110, but does not overlap with the abrasive member 110. For example, a distance between the mounting portion 122 of the body 120 and the bent portion 142 may be shorter than the distance between the mounting portion 122 of the body 120 and the abrasive member 110. Therefore, even if the bent portion 142 is disposed near the abrasive member 110, the rotation of the abrasive member 110 is not hindered by the bent portion 142.

Referring back to FIG. 2, the second bracket 150 may fix the guide unit 140 to the body 120. The second bracket 150 may fix the guide unit 140 to the mounting part 122 of the body 120. The second bracket 150 may be mounted on the mounting portion 122 of the body 120. The mounting portion 122 may extend from one side of the body 120 along the longitudinal direction of the rotation shaft 121. The mounting portion 122 may have a circular shape, but is not limited thereto. The second bracket 150 may be mounted around the outer periphery of the mounting portion 122.

The second bracket 150 may include a fixing part 151 fixed around the outer periphery of the mounting part 122. The fixing part 151 may include an inserting hole 151*a* penetrating through the center. The mounting portion 122 of the body 120 may be inserted through the inserting hole 151*a* of the fixing portion 151. Although not shown, the body 120 has a stopper disposed in contact with the mounting portion 122, so that the fixing portion 151 is not separated past the mounting portion 122 of the body 120 by this stopper. By this stopper, one side of the fixing part 151 may coincide with one side of the mounting part 122, and the other side of the fixing part 151 may be in surface contact with the stopper.

The second bracket 150 may include an insertion part 152 through which the guide unit 140 is inserted into one side of the fixing part 151. The insertion part 152 may include, for example, an inserting hole 152*a* through which the center passes. Accordingly, the guide unit 140 may be inserted through the inserting hole 152*a* of the insertion part 152.

The second bracket 150 may include a first pressing member 153 for pressing the guide unit 140 to fix the insertion part 152. If the guide unit 140 is not fixed after being inserted into the insertion part 152, the guide unit 140 may be separated from the insertion part 152, so that the function of the guide unit 140 cannot be implemented. Accordingly, after the guide unit 140 is inserted into the insertion part 152, the first pressing member 153 may be pressed so that the guide unit 140 is strongly fixed to the inside of the insertion part 152. Although not shown, the guide unit 140 may be formed in a plurality of fixing grooves on the surface of the guide bar 141 along the length direction of the guide bar 141. In this case, the first pressing member 153 passing through the insertion part 152 is inserted into the fixing groove of the guide bar 141, so that the guide bar 141 may be fixed by the first pressing member 153, in addition, the guide unit 140 may be firmly fixed to the inserting hole 152*a* of the inserting portion 152 by pressing the first pressing member 153.

For example, the first pressing member 153 may be a fastening part such as a bolt. The first pressing member 153 may press the guide unit 140 through the insertion part 152 in a direction perpendicular to the longitudinal direction of the rotation shaft 121 or the guide bar 141. The insertion part 152 may include a through hole (not shown) to penetrate the first pressing member 153. A thread may be formed inside the through hole, and a thread may be formed around the outer circumference of the first pressing member 153 facing the through hole. Therefore, after the first pressing member 153 is inserted, for example, rotated clockwise in the through hole of the insertion part 152, the guide unit 140 positioned in the inserting hole 152*a* of the insertion part 152 By pressing, the guide unit 140 may be firmly fixed to the inserting hole 152*a* of the insertion part 152. As the first pressing member 153 is rotated counterclockwise so that the first pressing member 153 is separated from the insertion part 152, the fixing of the guide unit 140 is released, and the guide unit 140 is inserted into the insertion part 152.

The second bracket 150 may include a second pressing member 154 that presses the fixing part 151 to the mounting part 122. If the mounting portion 122 of the body 120 is not fixed after being inserted into the inserting hole 151*a* of the fixing portion 151, the mounting portion 122 of the body 120 may be separated from the fixing portion 151, since the second bracket 150 is not fixed to the body 120, the guide unit 140 may not be fixed either. Therefore, after the mounting portion 122 of the body 120 is inserted into the inserting hole 151*a* of the fixing portion 151, the second pressure so that the fixing portion 151 can be strongly fixed to the mounting portion 122 of the body 120 The member 154 may be pressed.

For example, the second pressing member 154 may be a fastening part such as a bolt. The second pressing member 154 may be fixed to the mounting portion 122 of the body 120 through the fixing portion 151 in a direction perpendicular to the longitudinal direction of the rotation shaft 121 or the guide bar 141. A plurality of fixing grooves 122*a* may be formed along the periphery of the mounting portion 122 of the body 120. The second pressing member 154 passing through the fixing part 151 is inserted into one of the fixing grooves 122*a*, so that the fixing part 151 is formed by the second pressing member 154 to the body 120 and it can be firmly fixed to the mounting portion 122 thereof.

The fixing part 151 may include a through hole (not shown) so that the second pressing member 154 passes. A thread may be formed inside the through hole, and a thread may be formed around the outer circumference of the second pressing member 154 facing the through hole. Therefore, after the second pressing member 154 is inserted, for example, rotated clockwise in the through hole of the fixing part 151, the body 120 positioned in the inserting hole 151*a* of the fixing part 151 inserted into the fixing groove 122*a* formed around the mounting portion 122, the fixing portion 151 may be firmly fixed to the mounting portion 122 of the body 120. As the second pressing member 154 is rotated counterclockwise and the second pressing member 154 is separated from the fixing part 151, the fixing of the fixing part 151 is released, and the fixing part 151 can be detached from the mounting portion 122 of the body 120.

According to the first embodiment, the guide unit 140 is disposed near the abrasive member 110 to seal the target material 11 regardless of whether the sealing surface 15 contacts or is spaced apart from the open area 13. The hairline can be accurately formed on the sealing surface 15. Accordingly, the process time for forming the hairline on the sealing surface 15 of the target material 11 can be drastically shortened, and it is possible to easily and accurately form the hairline, so that it can minimize the sealing defect of the target material 11.

FIGS. 4 to 8 show a process of assembling the apparatus for forming a hairline according to the first embodiment.

As shown in FIG. 4, a first bracket 130 including a rotation shaft 131 and a pressing member 132 may be provided.

Figure 5:
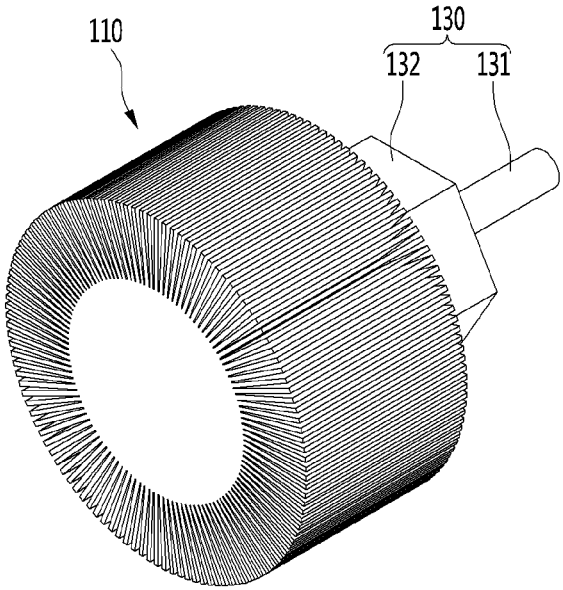

As shown in FIG. 5, after one side of the abrasive member 110 penetrates the pressing member 132 and is inserted into the insertion groove 133 of the rotation shaft 131, the pressing member 132 may be pressed. Each separation region 134 of the rotation shaft 131 is pressed by the pressing member 132 so that the rotation shaft 131 may be fixed to the abrasive member 110 by the pressing member 132.

Figure 6:
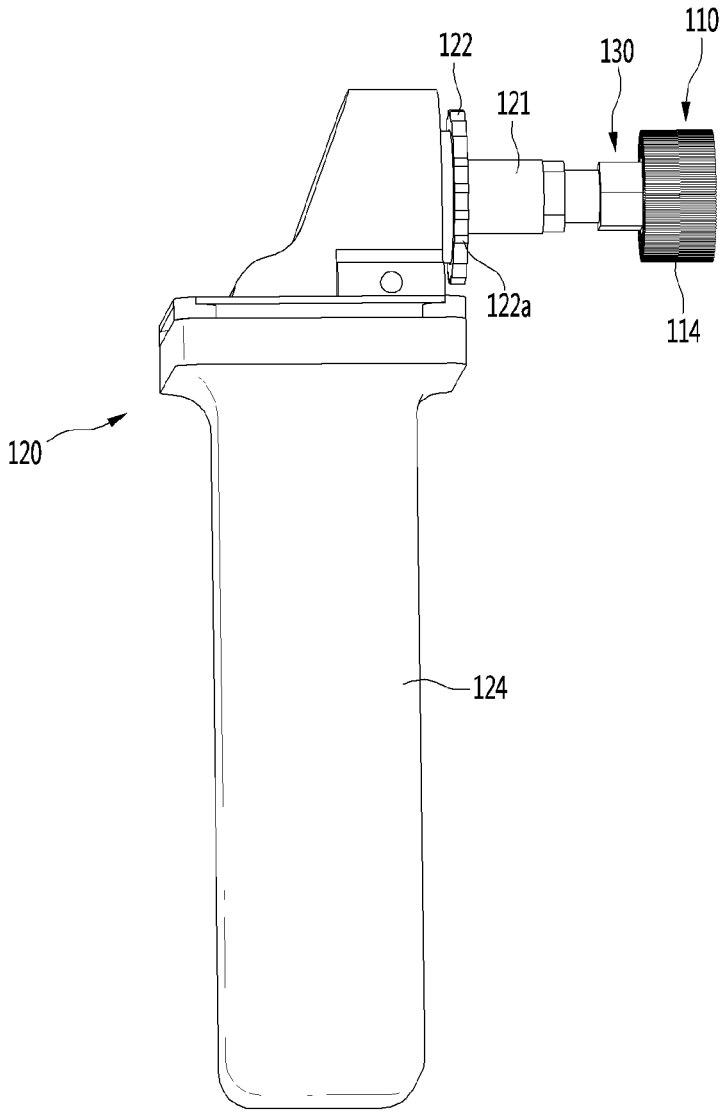

As shown in FIG. 6, the rotation shaft 131 of the first bracket 130 may be fastened to the rotation shaft 121 connected to the body 120. For example, the rotation shaft 131 of the first bracket 130 may be fixed after being inserted into the rotation shaft 121 of the body 120, but this is not limited thereto.

Accordingly, when the rotation shaft 121 of the body 120 is rotated, the rotation shaft 131 of the first bracket 130 and the abrasive member 110 connected to the rotation shaft 131 may be rotated.

Figure 7:
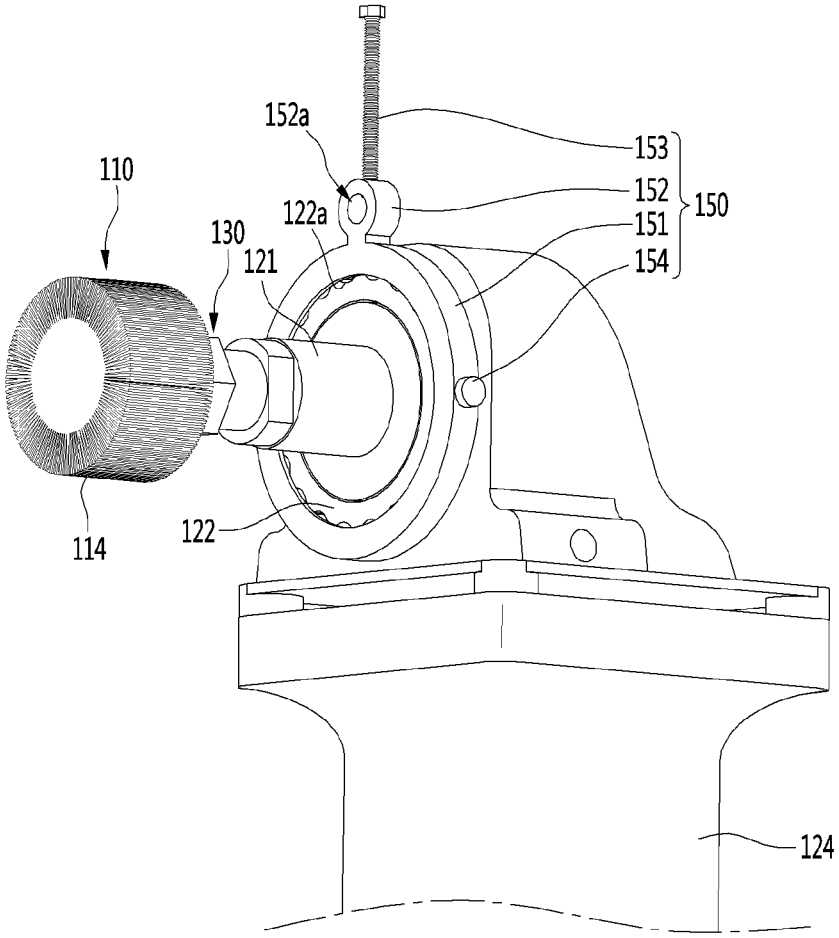

As shown in FIG. 7, after the fixing part 151 of the second bracket 150 is mounted around the mounting part 122 of the body 120, the second pressing member 154 rotates along one direction. Accordingly, the second pressing member 154 is inserted into the fixing groove 122*a* formed around the mounting portion 122 of the body 120 from the inside of the fixing portion 151, so that the fixing portion of the second bracket 150 151 may be fixed to the mounting portion 122 of the body 120.

Figure 8:
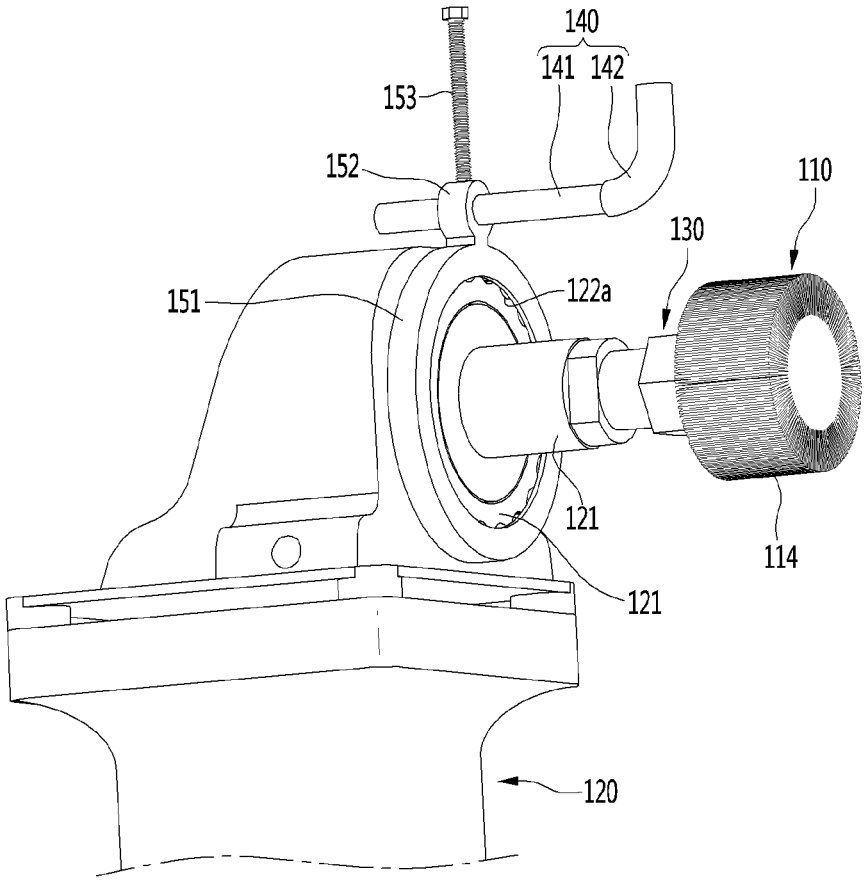

As shown in FIG. 8, after the guide unit 140 passes through the insertion part 152 of the second bracket 150, the first pressing member 153 may be rotated along one direction. Accordingly, the first pressing member 153 may press the guide unit 140 from the inside of the insertion part 152 so that the guide unit 140 may be fixed to the insertion part 152.

Figure 9:
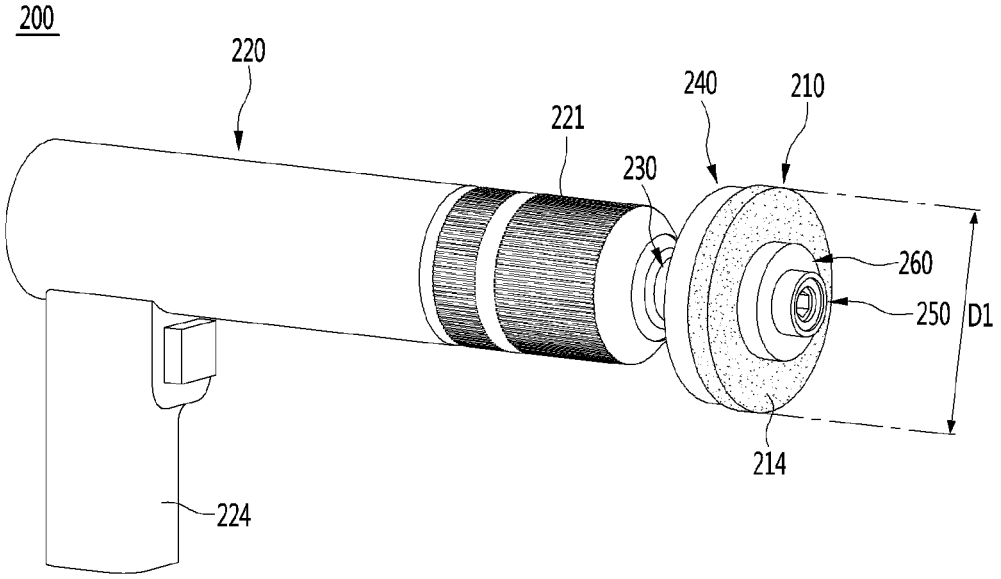
FIG. 9 shows an apparatus for forming a hairline according to a second embodiment.
Figure 10:
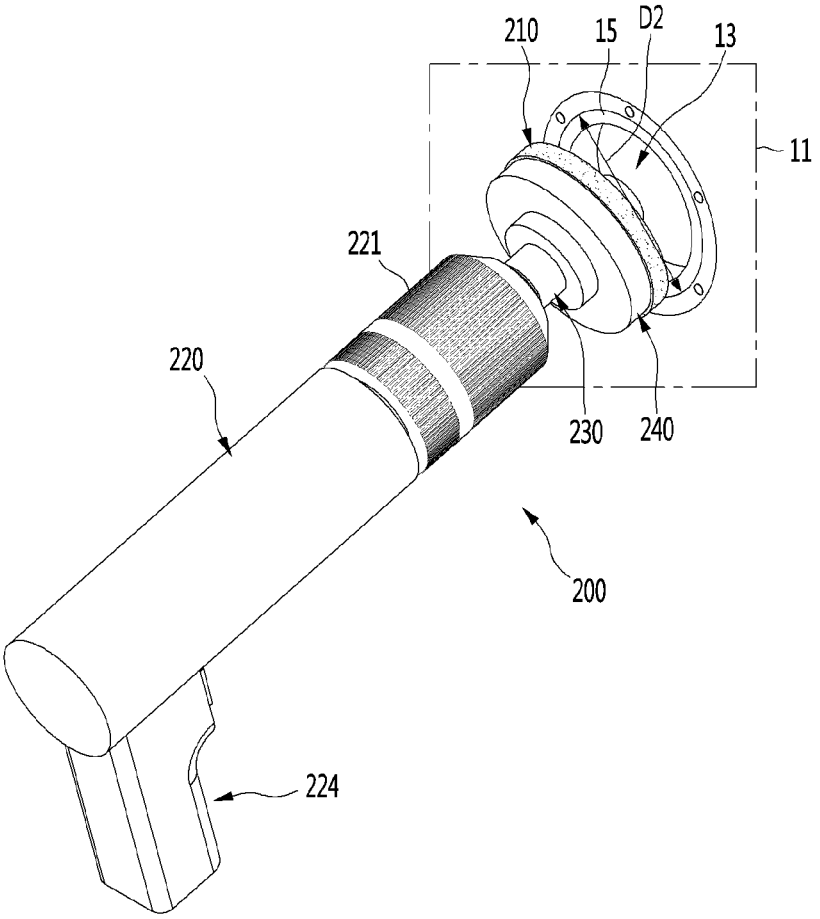
FIG. 10 shows a state of polishing a molding surface of a target material using the apparatus for forming a hairline according to the second embodiment.

FIG. 9 shows an apparatus for forming a hairline according to a second embodiment, and FIG. 10 shows a state of polishing a molding surface of a target material 11 using the apparatus for forming a hairline according to the second embodiment.

FIGS. 11 to 14 show a process of assembling the apparatus for forming a hairline according to the second embodiment.

The second embodiment is similar to the first embodiment. In the second embodiment, detailed descriptions of components having the same function, structure and/or shape as in the first embodiment are omitted.

FIGS. 9 and 10, the apparatus for forming a hairline 200 according to the second embodiment may include a body 220, a rotating shaft 230, an abrasive member 210, and a fastening part 250.

The body 220 of the second embodiment is slightly different from the body 120 of the first embodiment in terms of shape, but the practical functions are the same.

A rotation shaft 221 is provided on one side of the front end of the body 220 so that it can be rotated during polishing. The handle 224 is provided at the rear end of the body 220, so that the operator can perform the work while holding the handle 224 when polishing.

For example, after the rotation shaft rotation shaft 230, the abrasive member 210 and the fastening part 250 are pre-assembled, the rotation shaft 230 may be fastened to the rotation shaft 221 of the body 220.

Figure 11:
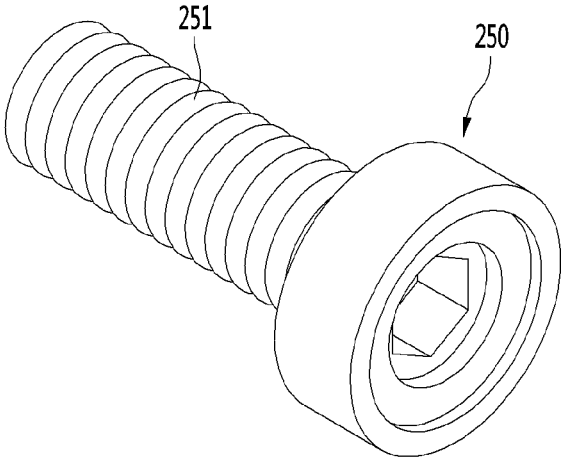
FIGS. 11 to 14 show a process of assembling the apparatus for forming a hairline according to the second embodiment.

As shown in FIG. 11, the fastening part 250 may be provided to fasten the rotation shaft rotation shaft 230 and the abrasive member 210. The fastening part 250 may have a fastening bar 251 that extends long along one direction.

Figure 12:
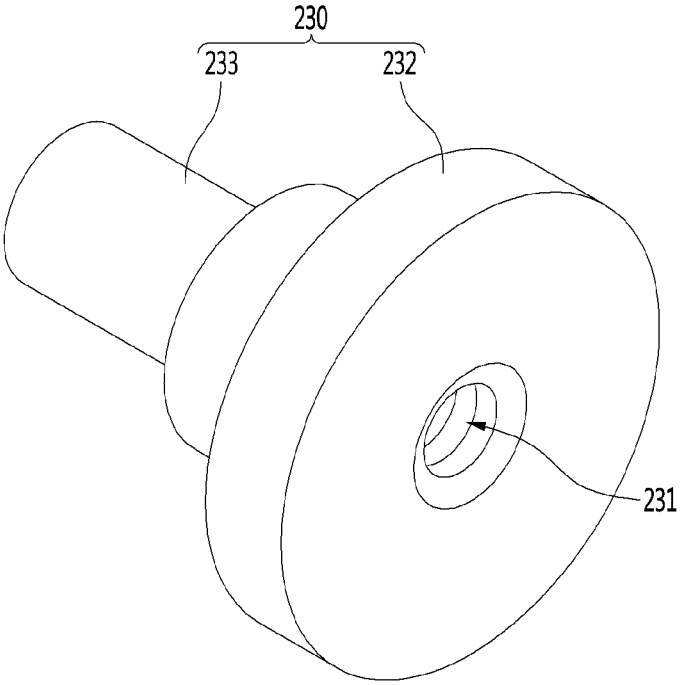

As shown in FIG. 12, the rotation shaft rotation shaft 230 includes a circular plate region 232 and a rotation region 233 extending from the plate region 232 toward the rotation axis 221 of the body 220. This rotation region 233 may be fastened to the rotation shaft 221 of the body 220.

Figure 13:
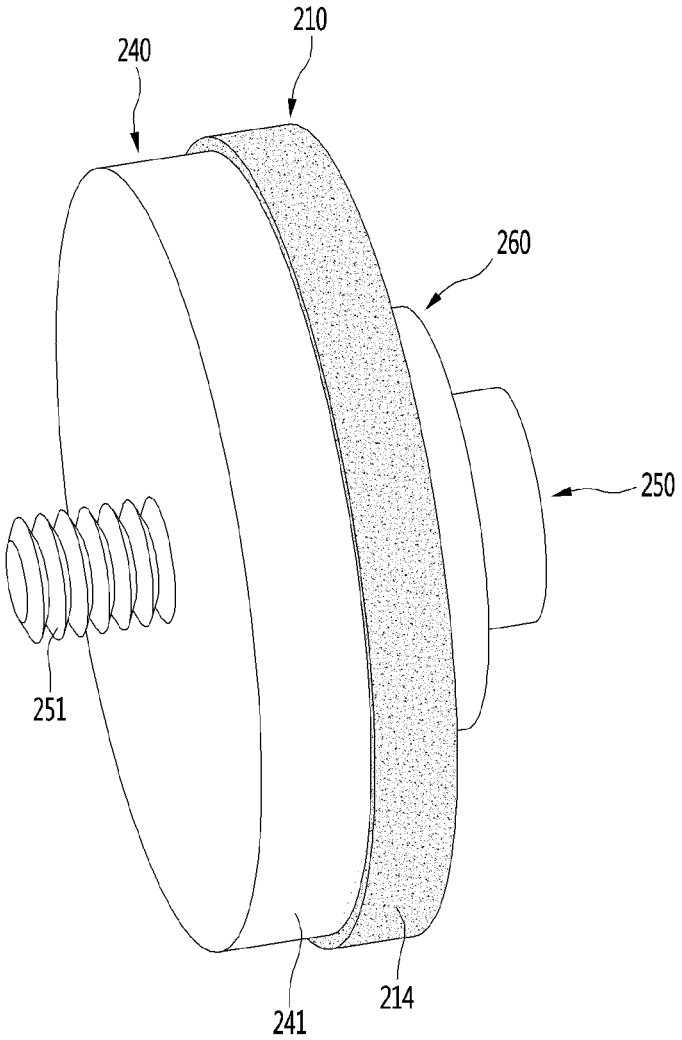

As shown in FIG. 13, after the guide unit 240 and the abrasive member 210 are arranged in surface contact, the fastening bar 251 of the fastening part 250 sequentially can be inserted to penetrate into the abrasive member 210 and the guide unit 240.

Figure 14:
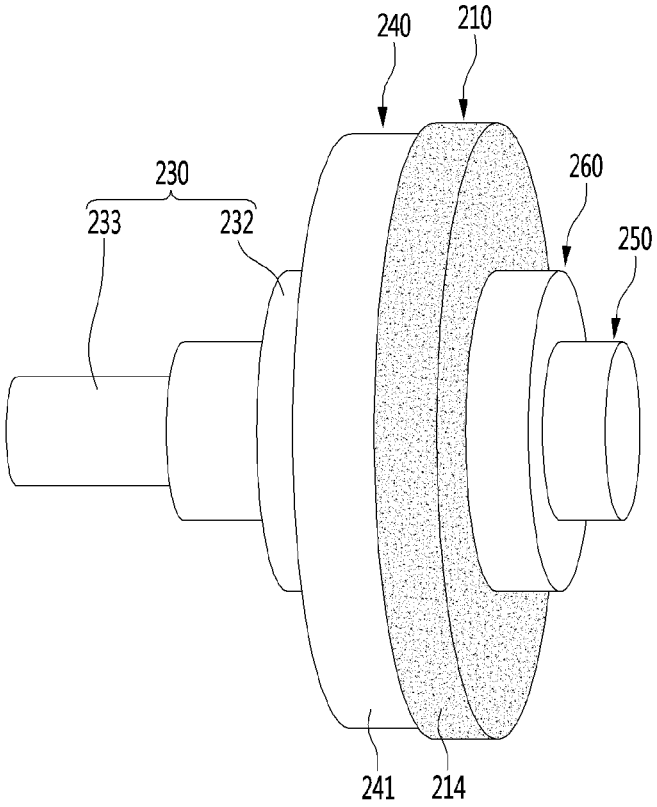

As shown in FIG. 14, after the plate region 232 of the rotation shaft 230 is arranged to be in surface contact with the guide unit 240, the fastening bar 251 of the fastening part 250 passing through the guide unit 240 may be fastened to the rotation shaft 230. For this fastening, the rotation shaft 230 may include an insertion groove 231. Accordingly, the fastening bar 251 of the fastening part 250 penetrating the abrasive member 210 and the guide unit 240 may be fastened to the insertion groove 231 of the rotation shaft 230. A thread is formed on the outside of the fastening bar 251 of the fastening part 250, and a thread is formed inside the insertion groove 231 of the rotation shaft 230, so that the fastening bar 251 of the fastening part 250 can be firmly fastened to the insertion groove 231.

Meanwhile, the abrasive member 210 may have a circular shape. The guide unit 240 may be disposed between the rotating part 230 and the abrasive member 210. The guide unit 240 may be in surface contact with the abrasive member 210. The guide unit 240 may have a circular shape. After arranging the polishing surface 214 of the abrasive member 210 in contact with the sealing surface 15 of the target material 11, while the abrasive member 210 can be rotated and the body 220 is pressed toward the target material 11, the sealing surface 15 of the target material 11 is polished by the polishing surface 214 of the abrasive member 210, so that a hairline can be accurately formed only on the sealing surface 15 of the target material 11.

For example, the diameter of the polishing surface 214 of the abrasive member 210 (D1 in FIG. 9) is the same as or larger than the diameter D2 of the sealing surface 15 of the target material 11, so that the polishing material 210 faces the sealing surface 15 of the target material 11 without moving the apparatus for forming the hairline 200 left and right in order to form a hairline on the sealing surface 15. Since the polishing surface 214 is disposed to rotate and press the polishing material 210, not only the hairline is more accurately formed only on the sealing surface 15 of the target material 11, but also the hairline formation time can be significantly shortened.

Meanwhile, the apparatus for forming a hairline 200 according to the second embodiment may include a support part 260. The support 260 may serve to support the abrasive member 210. The support 260 may be in surface contact with the abrasive member 210. The support part 260 may have a circular shape. The diameter of the support part 260 may be smaller than the diameter of the abrasive member 210. The support part 260 may be formed of the same material as the guide unit 240, but is not limited thereto.

The guide unit 240 and the support part 260 may be formed of a material having excellent support strength and durability. For example, the guide unit 240 and the support part 260 may be formed of a plastic material, a metal material, or an insulating material. After the fastening bar 251 of the fastening part 250 passes through the support part 260, the abrasive member 210, and the guide unit 240 in sequence, it is fastened to the insertion groove 231 of the rotation shaft 230, and the abrasive member 210 may be supported by the support part 260. The guide unit 240 may also serve as a support. That is, one surface of the abrasive member 210 may be supported by the support part 260, and the other surface of the abrasive member 210 may be supported by the guide unit 240.

The above detailed description should not be construed as limited in all respects and should be considered as illustrative. The scope of the embodiments should be determined by reasonable interpretation of the appended claims, and all changes within the equivalent scope of the embodiments are included in the scope of the embodiments.

EXPLANATION OF DRAWING NUMBER

11: target material 13: open area 14: inner surface 15: sealing surface 16: non-sealing surface
100, 200: apparatus for forming the hairline 110, 210: abrasive member 111: grinding paper
112, 121, 131, 221, 230: rotating shaft 114, 214: polished surface 120, 220: body
122: mounting portion 122*a*: fixing groove 124, 224: handle 130: first bracket
132, 153, 154: pressing member 133, 231: insertion groove 134: separation area 140,
240: guide unit 141: guide bar 142: bent portion 150: second bracket 151: fixing portion
151*a*, 152*a*: inserting hole 152: inserting portion 232: plate region 233: rotation region 241: guide surface 250: fastening portion 251: fastening bar 260: support

The invention claimed is:

1. An apparatus for providing a surface finish on a target material comprising:

a longitudinal body including a rotating shaft attached to a lateral portion of a first proximal portion of the longitudinal body, wherein a second distal portion of the longitudinal body forms a handle;

an abrasive member configured for providing the surface finish on the target material;

a first bracket for fixing the abrasive member to the rotating shaft;

a guide unit attached to the lateral portion or an end portion of the first proximal portion of the longitudinal body, comprising:

a guide bar having a first end and a second end, wherein the first end of the guide bar is attached to the to the lateral portion of the first proximal portion of the longitudinal body at a further distance from the second distal portion of the longitudinal body than the rotating shaft, wherein the second end of the guide bar extends parallel to a longitudinal direction of the rotation shaft and perpendicular to a longitudinal direction of the longitudinal body, and wherein the second end of the guide bar disposed farthest from the longitudinal body is disposed closer to the longitudinal body than the abrasive member;

a bent portion at the second end of the guide bar, wherein the bent portion is disposed in a perpendicular direction to the rotating shaft and extends away from the abrasive member, wherein the abrasive member is not overlapped with the guide unit in the perpendicular direction through the bent portion or in the longitudinal direction through the guide bar;

the longitudinal body further comprising a ring shaped mounting portion encircling the rotating shaft at the lateral portion of the first proximal portion of the longitudinal body;

the apparatus further comprising a second bracket that includes:

a ring shaped fixing part directly attached to an anterior portion of the ring shaped mounting portion of the body; and an inserting portion directly attached to the fixing part and including an inserting hole securing the first end of the guide bar to the mounting portion.

2. The apparatus of claim 1, wherein the inserting portion is disposed at a further distance from the second portion of the longitudinal body than the rotating shaft.

3. The apparatus of claim 1, wherein the bent portion is bent at the second end of the guide bar and is disposed parallel to an inner surface of the abrasive member.

4. The apparatus of claim 1, wherein the bent portion is positioned between the fixing part and the abrasive member, wherein a position of the bent portion is adjustable along the longitudinal direction of the rotation shaft.

5. The apparatus of claim 1, wherein the bent portion of the guide unit is placed farther from the surface finish than the abrasive member.

6. The apparatus of claim 1, wherein the guide unit is not disposed on the surface finish.

7. The apparatus of claim 1, wherein the guide unit does not surround the abrasive member.

8. The apparatus of claim 1, wherein a distance between the bent portion and the longitudinal body along the longitudinal direction is adjustable along the longitudinal direction of the rotation shaft.

9. The apparatus of claim 1, wherein the abrasive member comprises a polishing surface positioned on an outer portion of the abrasive member.

10. The apparatus of claim 9, wherein the polishing surface positioned on the outer portion of the abrasive member comprises grinding paper.

11. The apparatus of claim 1, wherein the bent portion at the second end of the guide bar is configured to engage a first surface to position the abrasive member against the target material that is perpendicular to the first surface.

12. The apparatus of claim 1, wherein the polishing surface positioned on the outer portion of the abrasive member is configured to generate a hairline finish on the target material.

* * * * *